US007611089B2

(12) United States Patent
Häfner

(10) Patent No.: US 7,611,089 B2
(45) **Date of Patent: *Nov. 3, 2009**

(54) SPOOL FOR RECEIVING A WINDABLE SKEIN MATERIAL

(75) Inventor: Manfred Häfner, Leopoldshöhe (DE)

(73) Assignee: Häfner & Krullmann GmbH, Leopoldshöhe (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/908,129

(22) PCT Filed: Mar. 8, 2006

(86) PCT No.: PCT/EP2006/002138

§ 371 (c)(1),
(2), (4) Date: Oct. 26, 2007

(87) PCT Pub. No.: WO2006/094790

PCT Pub. Date: Sep. 14, 2006

(65) Prior Publication Data

US 2008/0087757 A1 Apr. 17, 2008

(30) Foreign Application Priority Data

Mar. 9, 2005 (DE) ..... 10 2005 010 709

(51) Int. Cl.
*B65H 75/14* (2006.01)

(52) U.S. Cl. ..... 242/608; 242/608.2; 242/608.5; 242/608.6; 242/118.4

(58) Field of Classification Search ..... 242/608, 242/608.2, 608.5, 608.6, 118.4, 118.61
See application file for complete search history.

(56) References Cited

U.S. PATENT DOCUMENTS

| | | | | |
|---|---|---|---|---|
| 3,796,387 | A * | 3/1974 | Zielke | 242/606 |
| 5,593,108 | A * | 1/1997 | Eck et al. | 242/608.5 |
| 5,779,186 | A * | 7/1998 | Bakker et al. | 242/609.1 |
| 5,803,401 | A | 9/1998 | Matsuzoe | |
| 6,089,500 | A * | 7/2000 | Hafner | 242/608.5 |
| 6,343,765 | B1 | 2/2002 | Wen | |
| 2007/0181739 | A1 * | 8/2007 | Derendal | 242/608.5 |
| 2007/0262192 | A1 * | 11/2007 | Derendal | 242/608.5 |

FOREIGN PATENT DOCUMENTS

| | | |
|---|---|---|
| DE | 197 00 185 A1 | 7/1998 |
| DE | 197 06 832 C1 | 7/1998 |
| DE | 298 22 211 U1 | 2/1999 |
| WO | 02/08107 A1 | 1/2002 |

* cited by examiner

*Primary Examiner*—Sang Kim
(74) *Attorney, Agent, or Firm*—Richard M. Goldberg

(57) ABSTRACT

Spool for receiving wound skein material with a rotationally symmetrical conical spool body (10) with a detachable flange disc (14) at the end with the smaller diameter, in which the flange disc (14) and spool body (10) have ring surfaces (18, 20) on their facing surfaces, locking projections (20, 22) extend from the ring surface of one or both part(s) in the direction of the other ring surface, detent recesses (24, 26) to receive the locking projections are provided in the ring surface of one or both part(s), the locking projections and detent recesses can be locked in the manner of a bayonet catch by mutually rotating the spool body and the flange disc, and aligned with the detent recesses are spring-loaded tongues (38) which engage behind the locking projections in the connected position of the parts, and prevent the parts from untwisting.

5 Claims, 2 Drawing Sheets

SPOOL FOR RECEIVING A WINDABLE SKEIN MATERIAL

BACKGROUND OF THE INVENTION

The invention relates to a spool for receiving a wound skein material with a rotationally symmetrical conical body provided with a detachable flange disc at the end with the smaller diameter.

Spools of this type are known of per se. They offer the advantage that, after removing the flange discs, the conical spool bodies can be space-savingly stacked, which considerably simplifies storage and transport whilst the spool is in transit between the spool manufacturer and skein material manufacturer, or during return transport of the empty spool from the user of the skein material to the manufacturer thereof.

The general disadvantage of prior art spools of this type is that the removal and subsequent reattachment of the flange disc is either relatively complicated, and may possibly even require the use of tools, or that the flange disc can become unintentionally detached.

SUMMARY OF THE INVENTION

The invention is based on the task of providing a spool of the aforementioned type, in which the flange disc can be attached and detached to and from the end of the spool body in relatively simple and speedy fashion, in particular without any need for tools, and is reliably protected against unintentional self-detachment.

To solve this task, the spool according to the present invention is characterised in that

- the flange disc and spool body have ring surfaces on their facing surfaces,
- locking projections extend from the ring surface of one or both part(s) in the direction of the other ring surface,
- detent recesses to receive the locking projections are provided in the ring surface of one or both part(s),
- the locking projections and detent recesses can be locked in the manner of a bayonet catch by mutually rotating the spool body and the flange disc,
- aligned with the detent recesses there are spring-loaded tongues which engage behind the locking projections in the connected position of the parts, and prevent the parts from untwisting.

According to the invention, therefore, there is a locking connection between the spool body and the flange disc which can be closed easily and released speedily. Unintentional release is prevented by a spring-loaded tongue which prevents the bayonet connection from untwisting in that the locking projection is retained in its position. This anti-untwist function is provided by spring-loaded tongues which, once the bayonet catch is shut, spring into their locking position. The springs have to be pressed out of their locking position in order to release the locking connection.

The connection may comprise locking projections on one surface and detent recesses on the other. Locking projections may also be provided on both surfaces, along with detent recesses on both surfaces, too. To prevent the bayonet connection from untwisting it is sufficient to ensure that just one of the locking projections is secured in the associated detent recess by a spring-loaded tongue.

The locking projections are preferably mushroom-shaped. That means they have a stem projecting from the corresponding ring surface, which ends in a radially overhanging head. The detent recesses are keyhole-shaped in the broadest sense, i.e. they have an enlarged entry area which receives the heads of the locking projections and, bordering in the circumferential direction, runs into a locking section which is narrower in the radial direction, inside which the head of the locking projections is engaged.

The surfaces of the wall elements limiting the locking sections on both sides are preferably contrived to slope upwards so that when the two parts are rotated, the heads of the locking projections are drawn forward and the connection is tensioned.

The spring-loaded tongues can be directly attached to the edge of the detent recesses. If made from plastic, the spring-loaded tongues can be injection-moulded directly onto the edge portion of the detent recesses during the production process.

To release the spring-loaded tongues, and hence the bayonet catch, pressure elements are preferably provided, which, when moved sufficiently, press the spring-loaded tongues out of their locking position. Several such pressure elements can be provided on a single ring which is displaceably disposed on one or both parts of the connection according to the invention.

BRIEF DESCRIPTION OF THE DRAWINGS

Examples of preferred embodiments will be described in more detail below with reference to the attached drawings.

DETAILED DESCRIPTION

Figure 1:
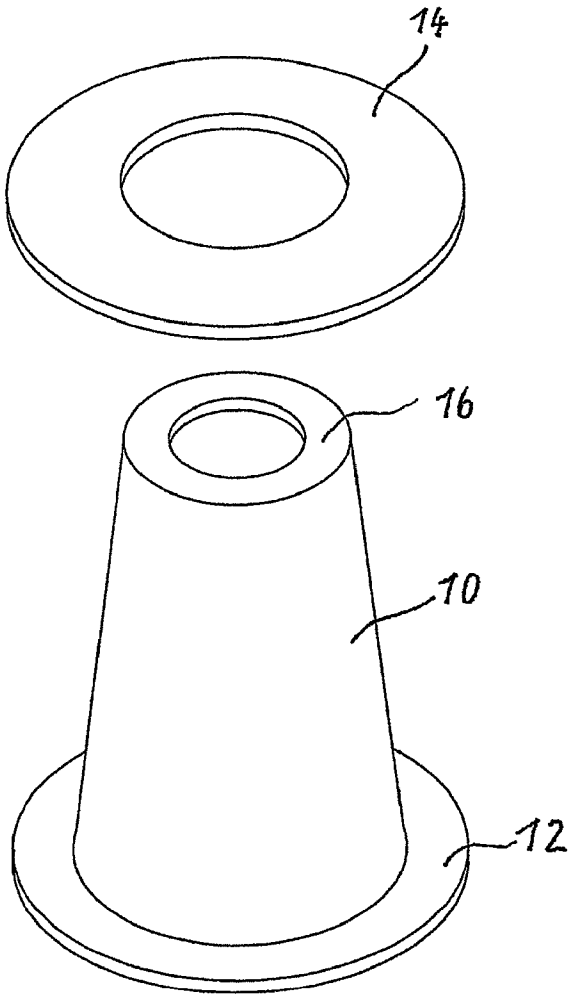
FIG. 1 is a diagrammatic perspective view of a spool according to the invention, in a partially disassembled exploded view.

FIG. 1 shows a truncated cone-shaped spool body 10 which at the lower end as shown in FIG. 1, with the larger diameter, is limited by a flange disc 12, which is rigidly connected to spool body 10, e. g. is produced with the latter in one piece as a plastic part, or may also be detachably affixed to spool body 10. Spool body 10 is detachably connected to another flange disc 14 at the end with the smaller diameter, to the top of FIG. 1.

The upper end surface of the truncated cone-shaped spool body 10 shown in FIG. 1 can be a fully closed surface, although a ring surface 26 running around the outer edge will suffice for the purpose of this invention.

There is a matching counter surface on the underside (not visible in FIG. 1) of flange disc 14. These two ring surfaces are provided with the connecting elements which allow a detachable connection between the spool body 10 and the flange disc 14.

According to FIG. 2, the connection between the flange disc 14 and spool body 10 is established by means of a blockable bayonet connection, as will be described in more detail below.

The elements of the bayonet connection are located on or in ring surface 16 at the front end of spool body 10 and on or in the underside of flange disc 14, which is not visible in FIG. 1. The ring surface there is designated as 18. Here, too, it may be noted that one ring surface is sufficient for accommodating the locking elements, and that the underside of flange disc 14 may be fully closed.

The bayonet connection between spool body 10 and flange disc 14 comprises locking projections 20, 22, which project downward from ring surface 18 of flange disc 14, and detent recesses 24, 26 in the ring surface 16 of the spool body.

Reference will be made below to the locking projection 20 of flange disc 14, and to detent recess 24 of the spool body 10 in particular.

Detent recess 24 has a contour which may at least be approximately described as resembling a keyhole shape. The contour comprises an entry area 28 which has a relatively large width in the radial direction, that is essentially perpendicular to the drawing plane, and adjoining the latter in a circumferential direction towards the left, a locking section 30 which is considerably narrower in the radial direction than the entry area. Both areas 28, 30 together can essentially be described as a keyhole-shaped opening in ring surface 16.

The locking projection 20 comprises a stem portion 32 which projects downwardly from ring surface 18, and a head 34 on the outer end of stem portion 32, which overhangs stem portion 32 in the radial direction at least.

The head is dimensioned such that it can be inserted into entry area 28 of detent recess 24, but after being moved into the locking section 30, is then held fast by mutual engagement.

In relation to the view in FIG. 1, several locking projections 20 are thus lowered downwardly into several entry areas 28 of ring surface 16, and flange disc 14 is then rotated onto spool body 10 in such a way that locking projections 20 are moved from the entry area 28 into the locking section 30 of detent recesses 24 and are then retained here by engagement. It can be seen that the underside of the ring surface on both sides of the detent recess slopes away in the circumferential direction inside locking section 30. This sloping surface 36 ensures that the head 34 of locking projection 20 is engaged by the sloping surface and the locking projection is tensioned downwards in relation to FIG. 2.

Figure 2:
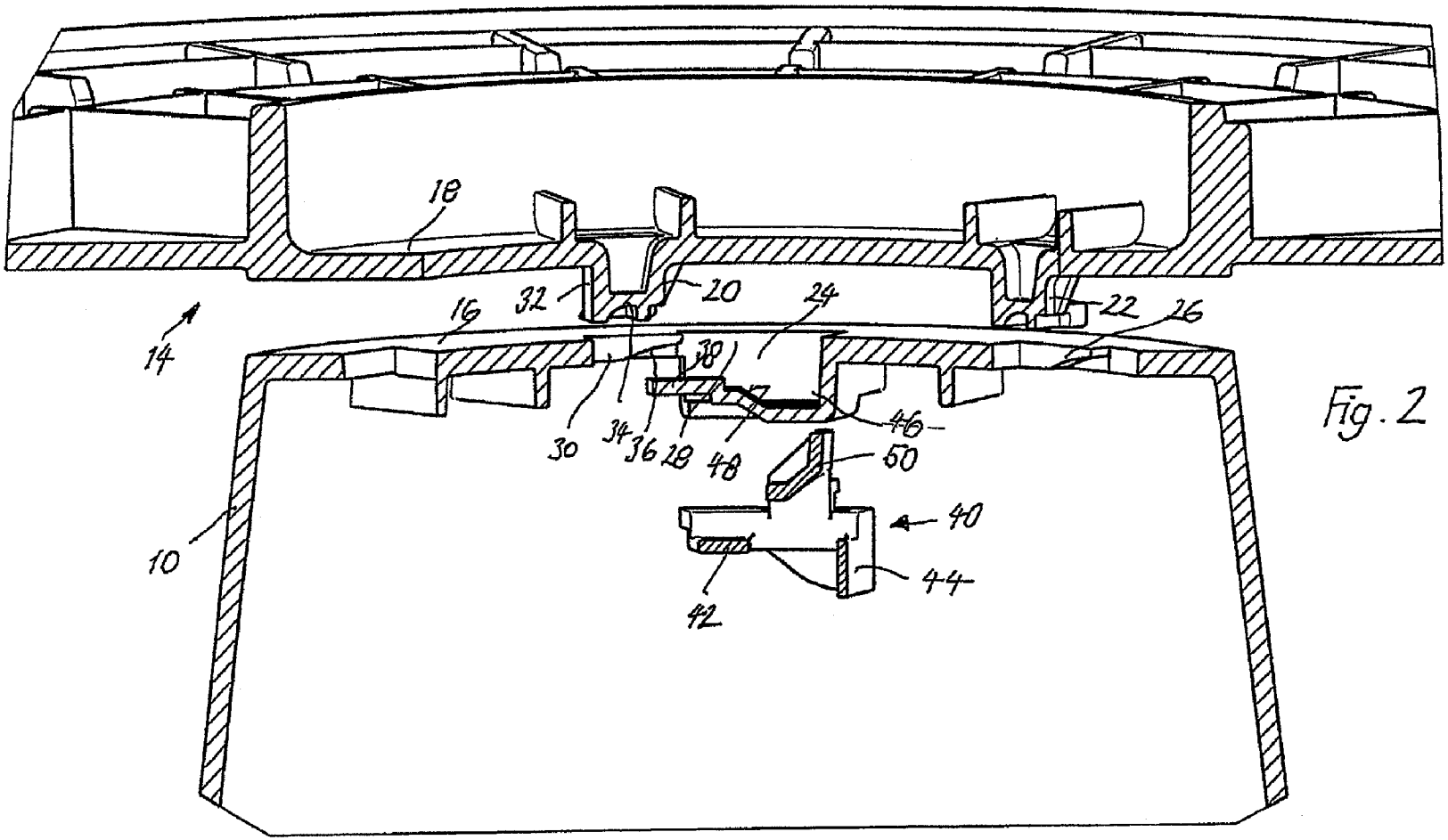
FIG. 2 is a partial section through the connecting portion between the spool body and the detachable flange disc according to the invention.

When the locking projections 20 in detent recesses 24 move to the left in FIG. 2, they press a spring-loaded tongue 38 downwards in FIG. 2. Once locking projections 20 have finally reached the end position of locking section 30, the spring-loaded tongue 38 is no longer in contact and can spring upwards in relation to FIG. 2. This means that the spring-loaded tongue 38 engages and grips locking projection 20 from its rear side, that is from the right of FIG. 2. The bayonet connection between locking projection 20 and detent recess 24 cannot be released by untwisting.

Flange disc 14 does have to be released, however, if, for example, the supply of material on spool body 10 has been fully unwound and the spool is to be transported back empty for renewed winding.

In this situation, flange disc 14 has to be removed so that spool body 10 can be space-savingly stacked with other spool bodies.

To release the bayonet catch for just such cases there is a pressure element 40 which is capable of pressing spring-loaded tongue 38 downward in relation to FIG. 2, thereby releasing locking projection 20 to be rotated in the direction of entry area 28 of the detent recess.

This pressure element 40 can be disposed inside detent recess 24 in such a way that it can be displaced in the circumferential direction. Two guide bars 42 on the pressure element engage behind the edges of detent recess 24 and guide the pressure element in this way. A downwardly oriented lip 44 in FIG. 2 occupies, in the starting position, a recess 46 contrived above spring-loaded tongue 38 and, when pressure element 40 is moved to the left in the circumferential direction of ring surface 16, slides over a sloping surface 48, which adjoins the recess, on the top face of spring-loaded tongue 38. All directional details given here relate to FIG. 2. This presses spring-loaded tongue 38 downwards, so that it releases the head 34 of locking projection 32.

On the top face of pressure element 40, slightly offset in relation to lower lip 44, there is another lip 50. This latter's function is to drive pressure element 40 when locking projections 20 are rotated to the right in FIG. 2, i.e. when the bayonet catch is released, when locking projection comes up against lip 50. In this way, lip 44 is also pushed back into recess 46, so that spring-loaded tongue 38 springs back again into the free starting position and can engage behind locking projection 20 once again when the bayonet catch is twisted shut.

The pressure element 40 can be provided for all locking projections 20, 22 or detent recesses 24, 26. Several pressure elements 40 can also be used on a peripheral ring.

In the embodiment illustrated, the downwardly directed locking projections 20, 22 are provided on the surface of flange disc 14 and the detent recesses 24, 26 on the surface of spool body 10. The locking projections and detent recesses can also be provided on both sides. That means that locking projections also can be provided on spool body 10, and detent recesses on flange disc 14.

In spool body 10, which forms the winding core for the skein-shaped material, openings may be provided to allow gases and liquids to be fed in from inside the spool body for the purpose of treating the windable product. Hot air can be blown through the windable product, for example, if it needs to be dried. Gaseous and liquid media can also be introduced for the purpose of treating the windable product.

The invention claimed is:

1. A spool for receiving wound skein material with a rotationally symmetrical conical spool body provided with a detachable flange disc at an end thereof with the smaller diameter, comprising:

ring surfaces on facing surfaces of the flange disc and spool body, locking projections extending from the ring surface of at least one of the flange disc and spool body in a direction of the other ring surface, detent recesses to receive the locking projections in the ring surface of at least one of the flange disc and spool body, wherein the locking projections and detent recesses can be locked in the manner of a bayonet catch by mutually rotating the spool body and the flange disc, spring-loaded tongues aligned with the detent recesses and which engage behind the locking projections in a connected position of the flange disc and spool body, so as to prevent the flange disc and spool body from untwisting, and displaceable pressure elements which press the spring-loaded tongues in one of the positions occupied by the pressure elements out of their engagement with the locking projections, and the pressure elements are formed on a ring which can be rotated around a rear face of the ring surfaces of parts of the spool.

2. The spool of claim 1, wherein:

the locking projections have projecting stem portions and, at ends thereof, radially overhanging heads, and the detent recesses comprise an enlarged entry area and, adjoining in the circumferential direction, a locking section which is narrower in the radial direction, behind which the head of locking projections engages.

3. The spool of claim 1, wherein rearward surfaces of the ring surface, which accommodates the detent recesses, are contrived in upwardly sloping fashion adjoining locking sections.

4. The spool of claim 1, wherein the spring-loaded tongue is affixed to an edge of the detent recesses.

5. The spool of claim 4, wherein the spring-loaded tongue is injection-molded in plastic.

* * * * *